United States Patent [19]

Ganssle

[11] Patent Number: 4,986,372

[45] Date of Patent: Jan. 22, 1991

[54] ELECTRICAL CABLE WITH SPIRALLY WRAPPED WIRES

[75] Inventor: Robert C. Ganssle, Huntington, Conn.

[73] Assignee: Hubbell Incorporated, Orange, Conn.

[21] Appl. No.: 406,332

[22] Filed: Sep. 12, 1989

[51] Int. Cl.[5] ..... H01B 7/22

[52] U.S. Cl. ..... 174/106 SC; 156/51; 156/56; 174/105 SC; 174/107; 174/108

[58] Field of Search ..... 174/105 R, 105 SC, 106 R, 174/106 SC, 107, 108, 102 R, 102 SC; 156/47, 51, 56

[56] References Cited

U.S. PATENT DOCUMENTS

| | | | |
|---|---|---|---|
| 1,880,060 | 9/1932 | Wanamaker | 174/107 |
| 2,163,235 | 6/1939 | Chatham | 174/107 |
| 3,351,706 | 11/1967 | Gnerre et al. | 174/105 |
| 3,760,812 | 9/1973 | Timm et al. | 128/418 |
| 3,794,750 | 2/1974 | Garshick | 174/107 |
| 4,131,757 | 12/1978 | Felkel | 174/107 |
| 4,157,452 | 6/1979 | Pignataro et al. | 174/36 |
| 4,469,539 | 9/1984 | Wade et al. | 174/105 SC X |
| 4,533,789 | 8/1985 | Katz | 174/102 R |
| 4,626,619 | 12/1986 | Uematsu | 174/106 SC |
| 4,719,320 | 1/1988 | Strait, Jr. | 174/106 R |
| 4,803,309 | 2/1989 | Marin et al. | 174/106 R |

FOREIGN PATENT DOCUMENTS

| | | | |
|---|---|---|---|
| 108237 | 8/1939 | Australia | 174/106 R |
| 1232628 | 1/1967 | Fed. Rep. of Germany . | |
| 2438308 | 2/1976 | Fed. Rep. of Germany . | |
| 3120146 | 11/1982 | Fed. Rep. of Germany . | |
| 3622 | of 1878 | United Kingdom | 174/108 |
| 332177 | 7/1930 | United Kingdom | 174/106 R |
| 506948 | 7/1939 | United Kingdom . | |
| 851549 | 10/1960 | United Kingdom . | |
| 864842 | 4/1961 | United Kingdom . | |

*Primary Examiner*—Morris H. Nimmo

*Attorney, Agent, or Firm*—Jerry M. Presson; Alfred N. Goodman

[57] ABSTRACT

An electric cable with spirally wrapped wires and wire-retaining strips thereon. The cable includes an insulated electrical conductor, an extruded semiconductive insulation shield overlying the insulated electrical conductor, a plurality of strips extruded and fused onto the insulation shield, and a plurality of wires wrapped around the insulation shield and the strips with sufficient tension to partially embed them into the strips to retain them therein and resist slippage. This arrangement also permits the selection of a first material having predetermined properties for the insulation shield and a second material for the strips having different properties from the first material composing the insulation shield. In one embodiment, the material selected for the strips has a higher softening or melting point than the softening or melting point of the material selected for the insulation shield. This embodiment reduces the pressure of the wires on the insulation shield to prevent indentation of the insulation shield. In another embodiment, the material selected for the strips has a higher coefficient of friction than the coefficient of friction of the material of the insulation shield and/or is a softer material than the material composing the insulation shield to further decrease the chances of slippage of the wires.

41 Claims, 1 Drawing Sheet

ELECTRICAL CABLE WITH SPIRALLY WRAPPED WIRES

FIELD OF THE INVENTION

The present invention relates to an electrical cable with spirally wrapped shielding and/or neutral return wires and wire-retaining strips thereon. More specifically, the invention relates to an electrical cable having an insulated electrical conductor, an extruded semiconductive insulation shield overlying the insulated electrical conductor, a plurality of wire-retaining strips extruded and fused onto the insulation shield, and a plurality of wires wrapped around the insulation shield and the strips with sufficient tension to partially embed them into the strips. The strips prevent shifting of the wires along the outer surface of the insulation shield during subsequent handling and use thereof.

BACKGROUND OF THE INVENTION

Presently many types of electrical cables are designed with spirally wrapped wires as the electrically neutral return circuit or as metallic electrical shielding. In particular, these types of electrical cables are commonly used to transfer power underground. Typically, the spirally wrapped wires are uniformly spaced apart from each other when wrapped around an internal insulation shield for uniform charge distribution. However, during subsequent handling and use of the electrical cable, often the spirally wrapped wires are shifted. Moreover, even when the wires are being wrapped over the relatively slippery surface of the insulation shield, the wires sometimes slip and abut one another. Thus, when two wires abut one another a small void is formed between the sides of the two wires and the insulation shield they overlie. When an outer jacket is extruded over the wires, such voids may create channels for undesirable ingress of water and allow separation of the insulation shield from the outer jacket.

In addition, when the outer jacket is extruded over the insulation shield and the wires, the insulation shield can become soft, and thus, may be significantly indented by the wires. If the insulation shield becomes excessively indented by the wires, then the indendations make it more difficult to prepare the cable for splicing and create channels for ingress of water at a splice or terminal.

While many attempts have been made to provide electrical cable with spirally wrapped wires that do not shift or excessively indent the insulation shield, numerous disadvantages are present in these prior electrical cables. Thus, many of these prior electrical cables are either expensive to manufacture or do not adequately prevent indentation of the insulation shield or slippage of the wires. An example of an electrical cable having ribs integrally extruded with a semiconductive insulation layer and helically wrapped by wires is disclosed in U.S. Pat. No. 3,351,706to Gnerre et al, the disclosure of which is hereby incorporated herein by reference. When the insulation shield is extruded with integral ribs, as in Gnerre et al, it is not possible to select a material for the ribs having different properties from the material composing the insulation shield. Accordingly, when the hot outer jacket is extruded over the insulation shield and the helical wires, the insulation shield and ribs become soft and the wires tend to indent into the insulation shield, since the ribs and the insulation shield are composed of the same material and have the same softening or melting point.

In addition, the material composing the insulation shield in prior cables is usually a relatively slippery material. Thus if the ribs are composed of the same material they also tend to be slippery. Moreover, if ribs are applied to the insulation shield by an adhesive, then the ribs tend to separate from the insulation shield due to changes in temperature on the electrical cable during use.

Other examples of prior electrical cables including spirally wrapped wires are disclosed in the following U.S. Pat. Nos., the disclosures of which are hereby incorporated herein by reference: 1,880,060 to Wanamaker; 2,163,235 to Chatham; 3,760,812 to Timm et al; 3,794,750 to Garshick; 4,131,757 to Felkel; 4,157,452 to Pignataro et al; 4,719,320 to Strait, Jr.; and 4,803,309 to Marin et al.

Examples of other prior electrical cables are disclosed in the following foreign patents: British Patent No. 506,948 to Callender's Cable Construction Company, Ltd.; British Patent No. 3,622 to Smith; British Patent No. 851,549 to Higgitt; British Patent No. 864,842 to Standard Telephones and Cables Ltd.; German Patent No. 2,438,308 to Cable and Metal Gutehoffen; and German Patent Nos. 1,232,628 to Cie. Generale D'Electricite, and 3,120,146 to Siemens AG.

SUMMARY OF THE INVENTION

Accordingly, a primary object of the invention is to provide an electrical cable with concentrically applied neutral wires that prevents shifting of the spirally wrapped neutral wires along its insulation shield.

Another object of the invention is to provide an electrical cable with concentrically applied neutral wires having a polymeric insulation shield composed of a first material having different properties from the material composing wire-retaining strips coupled to the shield.

Another object of the invention is to provide an electrical cable with concentrically applied neutral wires having a plurality of wire-retaining strips extruded directly onto its insulation shield and fused thereto.

Another object of the invention is to provide an electrical cable with concentrically applied neutral wires having wire-retaining strips composed of a material with a higher softening or melting point than the material composing the underlying insulation shield.

Another object of the invention is to provide an electrical cable with concentrically applied neutral wires having wire-retaining strips composed of a material with a higher coefficient of friction than the coefficient of friction of the material composing the underlying insulation shield.

Another object of the invention is to provide an electrical cable with concentrically applied neutral wires having wire-retaining strips composed of a softer material than the material composing the underlying insulation shield.

The foregoing objects are basically attained by a method of making an electrical cable comprising the steps of extruding an insulation shield, composed of a first material about an electrical conductor, extruding and bonding a plurality of strips, composed of a second material, onto the insulation shield, and spirally wrapping a plurality of wires about the insulation shield and the strips with sufficient tension to partially embed the wires into the strips.

The foregoing objects are also attained by providing an electrical cable, the combination comprising an electrical conductor; an insulation shield overlying the conductor and being composed of a first material; a plurality of strips overlying the insulation shield, composed of a second material, and fused to the insulation shield; and a plurality of wires spirally wrapped about the insulation shield and the strips, the wires being partially embedded into the strips.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings which form part of this original disclosure.

DETAILED DESCRIPTION OF THE INVENTION

Figure 1:
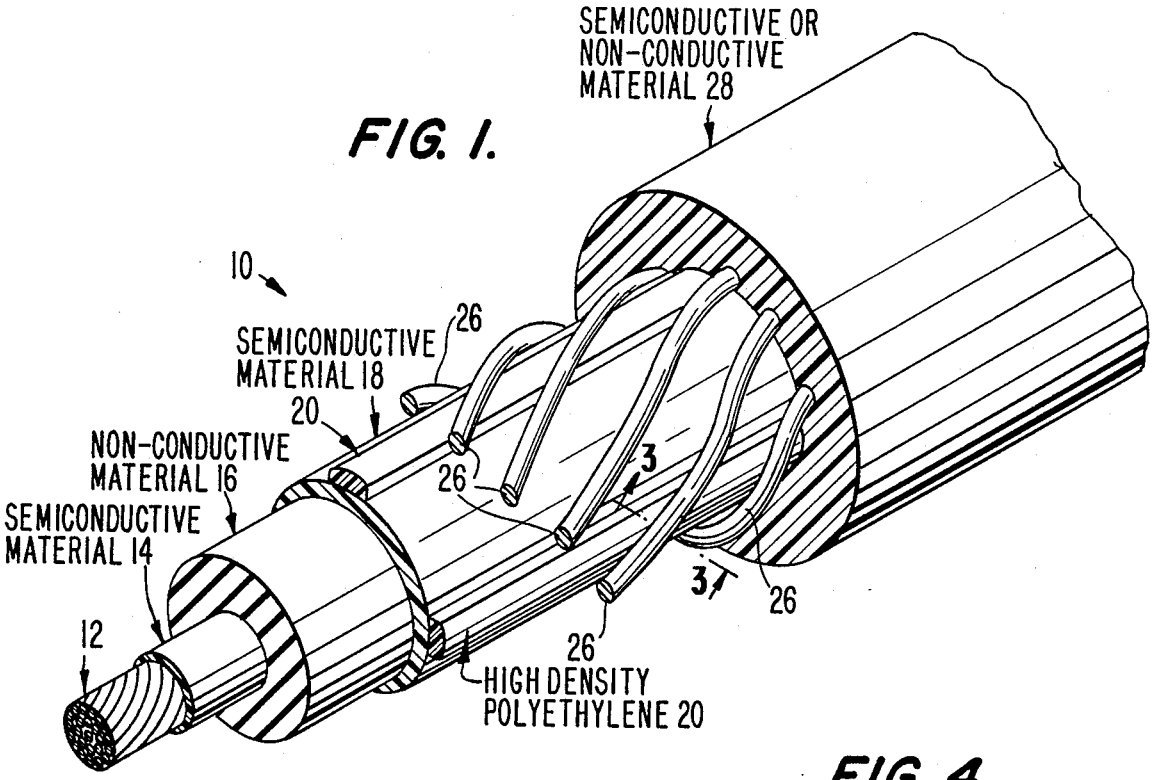
FIG. 1 is a right perspective view in partial section of an electrical cable in accordance with the present invention.

Referring initially to FIG. 1, an electrical cable 10 is illustrated in accordance with the present invention, and includes an electrical conductor 12, a first layer 14 extruded over and engaging conductor 12, a second layer 16 extruded over and engaging first layer 14, a third layer 18 extruded over and engaging second layer 16, a plurality of strips 20 extruded over and bonded onto third layer 18, a plurality of wires 26 spirally wrapped around and engaging third layer 18 and strips 20 and embedded in the strips, and an outer jacket 28 extruded over and engaging third layer 18, strips 20 and wires 26. As described in detail below, strips 20 retain the wires 26 in equally spaced, spiral positions, thereby assuring uniform spacing and the absence of intersticial voids caused by abutting wires.

Conductor 12 is substantially cylindrical and can be constructed from of a plurality of strands of wire (as shown) or can be a solid wire. Preferably, conductor 12 is made of copper or aluminum, although any suitable conductive material can be used.

First layer 14 is substantially cylindrical and is extruded over and in intimate contact with conductor 12. First layer 14 is composed of a high permittivity or semiconductive material which reduces electrical stress between the interfaces of conductor 12 and second layer 16. Preferably, first layer 14 is composed of a high permittivity material manufactured under the trademark PERMASHIELD by The Kerite Company, 49 Day Street, Seymour, Conn. 06483.

Second layer 16 is substantially cylindrical and is extruded over and in intimate contact with first layer 14. Second layer 16 is an insulation layer composed of a non-conductive material, such as ethylene propylene diene monomer (EPDM), although other suitable non-conductive materials may be used. The material composing layer 16 is preferably a material that resists the effects of electrical discharge and degradation due to water permeation.

Third layer 18 is substantially cylindrical and is an insulation shield composed of a semiconductive material, such as ethyl vinyl acetate/polyethylene copolymer with carbon black contained therein. An example of such a commercially available semiconductive material is USI YR 92126. Insulation shield or third layer 18 is extruded over and in intimate contact with second layer 16 and has a generally cylindrical outer surface with a durometer hardness of about 90. The insulation shield 18 is preferably a very thin layer which is easily removed at splices and terminals without the use of heat or special tools. The outside diameter of insulation shield 18 typically ranges from about three-fourths of an inch to about two inches depending on the size of conductor 12 being used. The insulation shield 18 is used to dissipate local electrical stresses on the underlying layers caused by static charge build-up, particularly at the wires 26.

Figure 2:
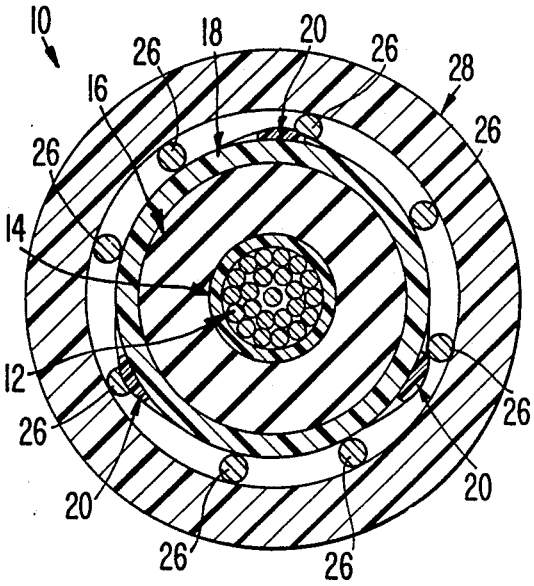
FIG. 2 is an enlarged left end elevational view of the electrical cable shown in FIG. 1.

Strips 20 are extruded directly onto insulation shield 18 causing them to fuse onto and bond with insulation shield 18. Preferably, the insulation shield 18 and strips 20 are extruded simultaneously to insure sufficient fusing therebetween due to the heat and pressure experienced during extrusion. As seen in FIG. 2, insulation shield 18 has three strips 20 extending radially outwardly therefrom, although more or fewer strips may be used depending upon the size of electrical cable 10. These strips 20 are straight, evenly spaced about the circumference of insulation shield 18 and preferably parallel to the longitudinal axis of shield 18 and extend axially therealong.

The extrusion temperature and pressure causes strips 20 to fuse to insulation shield 18. The term "fuse" as used herein means the joining or blending of materials by melting them together. By fusing strips 20 onto insulation shield 18, the strips will remain intimately bonded to insulation shield 18 over all temperatures in which electrical cable 10 may reasonably encounter, i.e., typically from −30° C. to 130° C. The materials forming the shield and the strips may be thermosetting or thermoplastic, are deformable but could be resilient.

Figure 3:
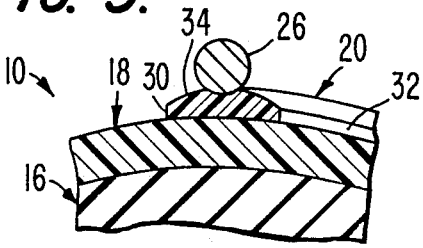
FIG. 3 is a further enlarged, partial elevational view of the first embodiment of FIG. 1 in cross section taken along line 3—3 of FIG. 1.

As seen in FIGS. 2 and 3, each strip 20 has a pair of straight and parallel end walls 30 and 32, and a curved outer surface 34, extending between end walls 30 and 32 for engaging wires 26. Preferably, end walls 30 and 32 are about 0.003 inch in height, while the highest point of the strips 20 along curved surface 34 is about 0.010 inch in height. The width of strips 20 range from about 0.300 inch to about 0.500 inch depending upon the size of the electrical cable being used.

Wires 26 are spirally wrapped about insulation shield 18 and strips 20 in a substantially uniform helical pattern and are substantially concentric to the insulation shield. While wires 26 are shown to be solid, they could also be made of a group of filaments. Preferably, wires 26 are made of copper, which may be bare or tinned, or aluminum and may be round or flat wires. Wires 26 are wrapped around insulation shield 18 and strips 20 with about 10 to 40 pounds of tension thereon to partially embed them into strips 20, as seen in FIG. 3, to retain them therein and resist their slippage. The wires 26 are also slightly indented, or partially embedded, into the shield 18. While only eight wires 26 are shown, there may be six to thirty wires with the wires equally spaced apart from about one-sixteenth of an inch to about one-half inch.

Outer jacket 28 is substantially cylindrical, is optional and may be composed of either an insulating material or a semiconductive material, i.e., low density polyethylene, linear low density polyethylene, semi-conducting polyethylene or polyvinyl chloride. Outer jacket 28 is extruded over and in intimate contact with insulation shield 18, strips 20 and wires 26. Outer jacket 28 is extruded under high pressure to fill all voids between wires 26 and strips 20 and/or insulation shield 18. Advantageously, there are no inaccessible voids formed between two abutting wires since the strips 20 resist slippage or movement of the wires into an abutting relationship.

In the first embodiment shown in FIGS. 1, 2 and 3, strips 20 are composed of a high density polyethylene having a durometer hardness of about 90. The material composing strips 20 has a higher softening or melting point than the softening or melting point of the material composing insulation shield 18. Thus, during application of the outer jacket 28, strips 20 reduce the pressure of wires 26 on the insulation shield 18 to prevent any further indentation of insulation shield 18 by wires 26. In particular, strips 20 will remain hard when outer jacket 28 is extruded over insulation shield 18 and strips 20, while insulation shield 18 will tend to soften. Since strips 20 have a higher softening or melting point they will act as supports for wires 26, and thereby prevent wires 26 from indenting into insulation shield 18 when outer jacket 28 is extruded thereon.

Figure 4:
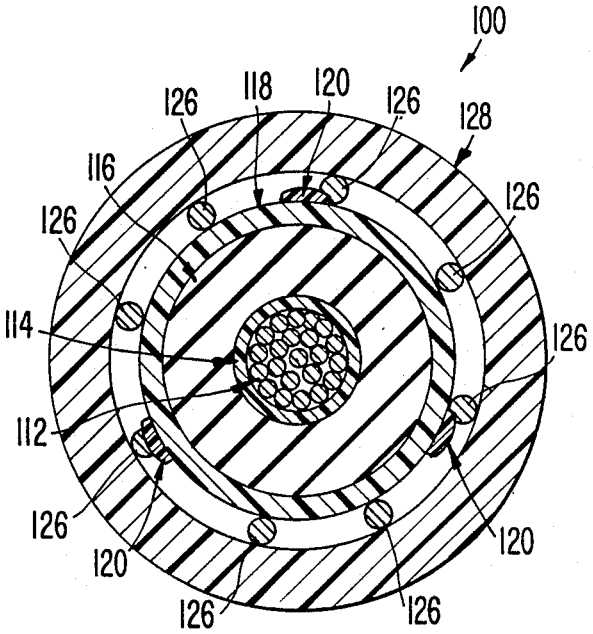
FIG. 4 is an end elevational view of a second embodiment of an electrical cable in accordance with the present invention.

As seen in FIG. 4, preferably, wires 26 are only partially embedded into strips 20 about 0.004 inch to about 0.005 inch to prevent the wires from indenting the shield 18.

The term "partially embedded" as used herein means that wires 26 are partially depressed into the strips 20, as seen in FIG. 3, and are gripped, retained and partially surrounded by the strips.

Figure 5:
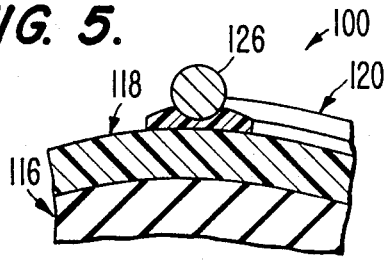
FIG. 5 is an enlarged, partial elevational of the second embodiment shown in FIG. 4 in cross section taken along a section line similar to section line 3—3 of FIG. 1.

Embodiment of FIGS. 4 and 5

As seen in FIGS. 4 and 5, a second embodiment of an electrical cable in accordance with the invention is illustrated, which is substantially identical to the first embodiment disclosed in FIGS. 1–3, except that modified strips 120 are composed of a different material from the material composing strips 20. The insulation shield 118 is made of the same material as shield 18.

Electrical cable 100 shown in FIGS. 4 and 5 includes a conductor 112, a first high permittivity or semiconductive stress control layer 114, a non-conductive second layer 116, an insulation shield 118, a plurality of wire-retaining strips 120, a plurality of wires 126, and an outer jacket 128.

Strips 120 are composed of a material having a higher coefficient of friction than the coefficient of friction of the material forming insulation shield 118 and/or having a lower durometer hardness than the hardness of the material forming insulation shield 118. Preferably, strips 120 have a durometer hardness of about 70 and are made of ethyl vinyl acetate/polyethylene copolymer such as USI ULTRATHENE 631-00. As seen in FIG. 5, wires 126 are embedded deeper into strips 120 than are wires 26 embedded into strips 20. This softer material and higher coefficient of friction increases the chances that wires 126 will not shift during subsequent handling and use, and especially if outer jacket 128 is not extruded thereon.

While only two embodiments have been chosen to illustrate the invention, it will understood by those skilled in the art that various changes and modifications can be made herein without the departing from the scope of the invention as defined in the appended claims.

What is claimed is:

1. A method of making an electrical cable, comprising the steps of
   extruding an insulation shield, composed of a first material, about an insulated electrical conductor,
   extruding and bonding a plurality of strips, composed of a second material which is different from the first material, onto the insulation shield, and
   spirally wrapping a plurality of wires about the insulation shield and the strips with sufficient tension to partially embed the wires into the strips.

2. The method according to claim 1, wherein
   the steps of extruding the insulation shield and the plurality of strips are conducted simultaneously.

3. The method according to claim 1, wherein
   the second material composing the strips has a higher softening point than the first material composing the insulation shield.

4. The method according to claim 3, and further comprising the step of
   extruding an additional layer of material overlying the wires, the strips and the insulation shield.

5. The method according to claim 1, wherein the step of extruding the insulation shield is preceded by the step of
   extruding a first layer of a high permittivity material over the conductor.

6. The method according to claim 1, wherein
   the second material composing the strips is softer than the first material composing the insulation shield, has a higher coefficient of friction than the coefficient of friction of the first material composing the insulation shield, or both.

7. The method according to claim 6, wherein
   the steps of extruding the insulation shield and the plurality of strips are conducted simultaneously.

8. The method according to claim 7, and further comprising the step of
   extruding an additional layer of material over the wires, the strips and the insulation shield.

9. The method according to claim 8, wherein the step of extruding the insulation shield is preceded by the step of
   extruding a first layer of a high permittivity material over the conductor.

10. The method according to claim 9, wherein the step of extruding the insulation shield is preceded by the step of
   extruding a second layer of non-conductive material over the first layer of a high permittivity material.

11. The method according to claim 10, wherein
   the first material composing the insulation shield is a semiconductive material.

12. The method according to claim 1, wherein
   the strips extend axially along the insulation shield and are circumferentially spaced apart about the insulation shield.

13. The method according to claim 1, wherein the step of extruding and bonding the strips onto the insulation shield includes the step of fusing the strips onto the insulation shield.

14. The method according to claim 13, wherein the steps of extruding the insulation shield and the strips are conducted simultaneously.

15. A method of making an electrical cable, comprising the steps of extruding a first layer of a high permittivity material over an electrical conductor, extruding a second layer of non-conductive material over the first layer of a high permittivity material, extruding an insulation shield, composed of a first material, about the electrical conductor, extruding and bonding a plurality of strips, composed of a second material which is different from the first material, onto the insulation shield, and spirally wrapping a plurality of wires about the insulation shield and the strips with sufficient tension to partially embed the wires into the strips.

16. The method according to claim 15, wherein the first material composing the insulation shield is a semiconductive material.

17. The method according to claim 16, wherein the semiconductive material comprises ethyl vinyl acetate/polyethylene copolymer with carbon black contained therein.

18. The method according to claim 15, wherein the second material composing the strips has a higher softening point than the first material composing the insulation shield.

19. The method according to claim 18, wherein the second material composing the strips is a high density polyethylene.

20. The method according to claim 19, wherein the steps of extruding the insulation shield and the plurality of strips are conducted simultaneously.

21. An electrical cable, the combination comprising:

an insulated electrical conductor;

an insulation shield overlying said conductor and being composed of a first material;

a plurality of strips overlying said insulation shield, composed of a second material which is different from said first material, and fused to said insulation shield; and a plurality of wires spirally wrapped about said insulation shield and said strips, and partially embedded into said strips.

22. An electrical cable according to claim 21, wherein said second material composing said strips has a higher softening point than said first material composing said insulation shield.

23. An electrical cable according to claim 22, wherein said second material composing said strips comprises a high density polyethylene.

24. An electrical cable according to claim 23, and further comprising an additional layer of material extruded over said insulation shield, said strips, and said wires.

25. An electrical cable according to claim 23, wherein said first material composing said insulation shield is a semiconductive material.

26. An electrical cable according to claim 25, wherein said semiconductive material comprises an ethyl vinyl acetate/polyethylene copolymer with carbon black contained therein.

27. An electrical cable according to claim 25, wherein each of said strips is about 0.300 inch to about 0.500 inch in width and about 0.010 inch in height at its highest point.

28. An electrical cable according to claim 27, wherein each of said wires is partially embedded into said strips about 0.004 inch to about 0.005 inch.

29. An electrical cable according to claim 21, wherein said second material composing said strips is softer than said first material composing said insulation shield, has a higher coefficient of friction than the coefficient of friction of said first material composing said insulation shield, or both.

30. An electrical cable according to claim 29, wherein said first material is composed of a copolymer.

31. An electrical cable according to claim 30, wherein said second material is composed of a copolymer.

32. An electrical cable according to claim 31, wherein said first material composing said insulation shield is a semiconductive material.

33. An electrical cable according to claim 21, and further comprising a first layer of a high permittivity material positioned between said conductor and said insulation shield.

34. An electrical cable according to claim 21, wherein each of said strips has a convexly curved outer surface for engage said wires.

35. An electrical cable according to claim 34, wherein each of said strips has a pair of substantially parallel end walls extending axially along said insulation shield, said curved outer surface extending between said end walls.

36. An electrical cable according to claim 21, wherein said strips extend axially along said insulation shield and are evenly spaced circumferentially about said insulation shield.

37. An electrical cable according to claim 21, wherein said wires are evenly spaced apart from each other.

38. An electrical cable, the combination comprising:

an electrical conductor;

an insulation shield overlying said conductor and being composed of a first material;

a first layer of a high permittivity material positioned between said conductor and said insulation shield;

a second layer of non-conductive material positioned between said first layer of a high permittivity material and said insulation shield;

a plurality of strips overlying said insulation shield, composed of a second material which is different from said first material, and fused to said insulation shield; and a plurality of wires spirally wrapped about said insulation shield and said strips, and partially embedded into said strips.

39. An electrical cable according to claim 38, and further comprising an additional layer of material extruded over said insulation shield, said strips, and said wires.

40. A method of making an electrical cable, comprising the steps of extruding a layer, composed of a first material, about an insulated electrical conductor, extruding and bonding a plurality of strips, composed of a second material, which is different from the first material onto the layer, and spirally wrapping a plurality of wires about the layer and the strips with sufficient tension to partially embed the wires into the strips.

41. An electrical cable, the combination comprising;

an insulated electrical conductor;

a layer overlying said conductor and being composed of a first material;

a plurality of strips overlying said layer, composed of a second material which is different from said first material, and fused to said layer; and a plurality of wires spirally wrapped about said layer and said strips, and partially embedded into said strips.

* * * * *